US007642889B2

(12) United States Patent
Suzuki et al.

(10) Patent No.: US 7,642,889 B2
(45) Date of Patent: Jan. 5, 2010

(54) INVERTER TRANSFORMER HAVING BOBBIN WITH PROTECTED TERMINAL PINS

(75) Inventors: Mitsuaki Suzuki, Kitasaku-gun (JP); Yoshinori Arao, Kitasaku-gun (JP)

(73) Assignee: Minebea Co., Ltd., Nagano (JP)

( * ) Notice: Subject to any disclaimer, the term of this patent is extended or adjusted under 35 U.S.C. 154(b) by 204 days.

(21) Appl. No.: 12/003,911

(22) Filed: Jan. 3, 2008

(65) Prior Publication Data

US 2008/0211616 A1 Sep. 4, 2008

(30) Foreign Application Priority Data

Feb. 19, 2007 (JP) ..... 2007-038188

(51) Int. Cl.
*H01F 27/30* (2006.01)

(52) U.S. Cl. ..... 336/198

(58) Field of Classification Search ..... 336/65, 336/86, 192, 198, 200, 220–223, 170, 232
See application file for complete search history.

(56) References Cited

U.S. PATENT DOCUMENTS 6,894,596 B2 * 5/2005 Suzuki ..... 336/83
7,154,366 B2 * 12/2006 Hsueh et al. ..... 336/198
7,345,565 B2 * 3/2008 Yang et al. ..... 336/200
7,456,719 B2 * 11/2008 Suzuki et al. ..... 336/198

FOREIGN PATENT DOCUMENTS

JP A 2006-303304 11/2006

* cited by examiner

*Primary Examiner*—Tuyen Nguyen
(74) *Attorney, Agent, or Firm*—Oliff & Berridge, PLC

(57) ABSTRACT

An inverter transformer includes a core structure, bobbins each including a spool portion and first and second terminal blocks and having a part of the core structure inserted therein, and primary and secondary windings wound around the bobbin, wherein the first and second terminal blocks have recesses formed at their end faces and adapted to lodge terminal pins to tie wire ends of the secondary winding therearound, the distal tip ends of the terminal pins lodged in the recesses of the first and second terminal blocks are positioned either flush with or inward of the end face of the first and second terminal blocks, parts of the core structure are located above the recesses, and the end faces of the core structure oriented substantially orthogonal to an extending direction of the terminal pins are positioned either flush with or outward of the distal tip ends of the terminal pins.

5 Claims, 6 Drawing Sheets winding direction:CW winding direction:CCW

INVERTER TRANSFORMER HAVING BOBBIN WITH PROTECTED TERMINAL PINS

BACKGROUND OF THE INVENTION

1. Field of the Invention

The present invention relates to an inverter transformer to light a discharge lamp used as a light source of a backlight device for a liquid crystal display device, and more particularly to an inverter transformer provided with a plurality of outputs and adapted to light a plurality of discharge lamps.

2. Description of the Related Art

Since liquid crystal of a liquid crystal display (LCD) device used for, for example, a television, a personal computer, and the like does not emit light by itself, a lighting device, such as a backlight device, is required. The backlight device employs as its light source a discharge lamp, typically, such as a cold cathode fluorescent lamp (CCFL). Recently, the LCD device is becoming larger and larger and also a higher brightness is required for use in, for example, an LCD television, and therefore the backlight device incorporates a plurality of CCFLs as its light source. A high voltage required to light a CCFL is produced such that a high frequency voltage generated at a switching of an inverter circuit is stepped up by an inverter transformer.

An inverter transformer generally includes a bobbin having primary and secondary windings wound therearound and a core having legs to be inserted in the hollow of the bobbin, and the primary and secondary windings are connected to an outside circuit disposed at a print circuit board, or the like via terminal pins implanted in the bobbin. In such the inverter transformer, the terminal pin is often bent and formed in an L shape or a square U shape such that lead-out wires of the windings are tied around one bar of the L or square U shape while another bar is fixedly attached to the printed circuit board, to thereby prevent breakage of the wires (refer to, for example, Japanese Patent Application Laid-Open No. 2006-303304, FIGS. 1 to 3 therein).

In the inverter transformer described above, the bar of the terminal pin having the winding wires tied therearound protrudes from the end face of the bobbin and is likely to be subjected to external stresses thus causing a winding breakage problem. This problem is serious particularly with the secondary winding wires which have a smaller diameter than the primary winding wires.

SUMMARY OF THE INVENTION

The present invention has been made in light of the problem described above, and it is an object of the present invention to provide an inverter transformer with multiple outputs, which has a structure adapted to enable reduction in breakage of secondary winding wires at wire tying portion.

According to an aspect of the present invention, an inverter transformer includes: a core structure composed of an outer core section and an inner core section; a plurality of bobbins each including a spool portion having a hollow, and first and second terminal blocks disposed respectively at both ends of the spool portion, wherein the inner core section of the core structure is inserted in the hollow of the spool portion; and primary and secondary windings wound around the spool portion, wherein the first terminal block of the bobbin has a recess formed at an end face thereof and lodging a terminal pin adapted to tie one wire end of the secondary winding therearound; the second terminal block has two recesses formed at an end face thereof and lodging two terminal pins, respectively, either one of the two terminal pins adapted to tie the other wire end of the secondary winding therearound; distal tip ends of the terminal pins lodged in the recesses of the first and second terminal pins are positioned either flush with or inward of the end face of the first and second terminal blocks; part of the core structure is located above the recess; and an end face of the core structure oriented substantially orthogonal to an extending direction of the terminal pins is positioned either flush with or outward of the distal tip ends of the terminal pins.

In the aspect of the present invention, the spool portion of the bobbin may include a first winding section located toward the first terminal block, a second winding section located next to the first winding section and adapted to have the primary winding wound therearound, and a third winding section located toward the second terminal block so as to sandwich the second winding section with the first winding section and adapted to have the secondary winding wound therearound; the first terminal block may be provided with first group grooves; the second winding section may be provided with second group grooves whose bottom planes are substantially flush with a surface of the first winding section; the second terminal block may be provided with third group grooves; and a wire of the secondary winding may have its one end tied around the terminal pin lodged in the recess of the first terminal block, pass through one groove of the first group grooves of the first terminal block, be wound at the first winding section by one turn, and pass through one of the second group grooves of the second winding section thereby reaching the third winding section.

In the aspect of the present invention, the bobbin may include a flange which separates the first winding section and the second winding section, and which is provided with two notches each having a first portion positioned inward and a second portion positioned outward, directly continuous with the first portion and having a greater width than the first portion thus constituting a step configuration.

In the aspect of the present invention, the first group grooves of the first terminal block and the third group groove of the second terminal block may have a trapezoidal cross section tapering inward from the surfaces of the first and second terminal blocks.

In the aspect of the present invention, the inverter transformer may be a leakage transformer.

According to the present invention, the inverter transformer is surely less likely to suffer wire breakage at the terminal pins to tie the wire of the secondary winding therearound while achieving downsizing and enhancing productivity, reliability and safety.

DETAILED DESCRIPTION OF THE INVENTION

An exemplary embodiment of the present invention will be described with reference to the accompanying drawings.

Figure 1:
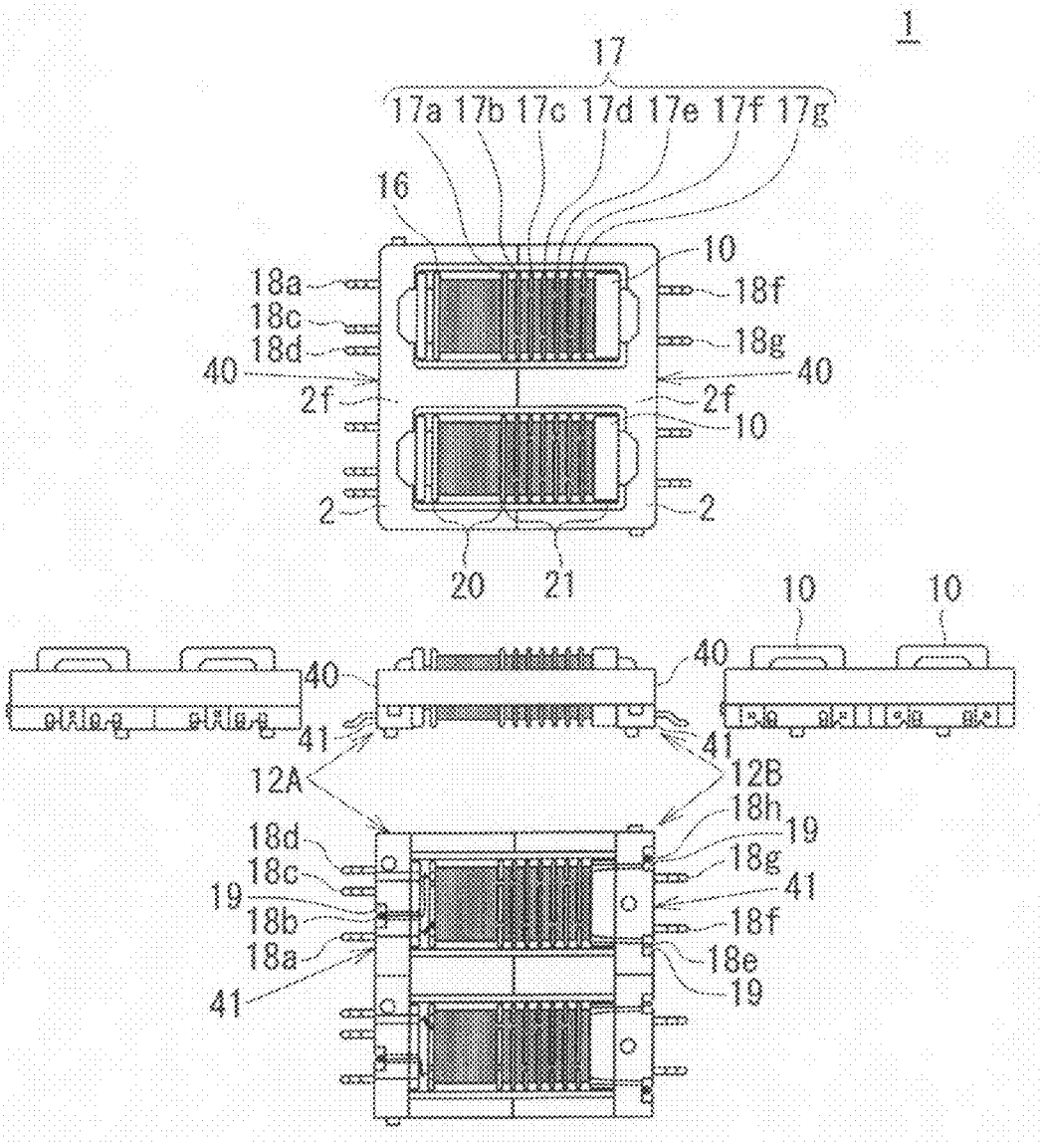
FIG. 1 is a set of views of an inverter transformer according to an embodiment of the present invention, specifically, a top plan view, a front elevation view, right and left side views, and a bottom view.
Figure 2:
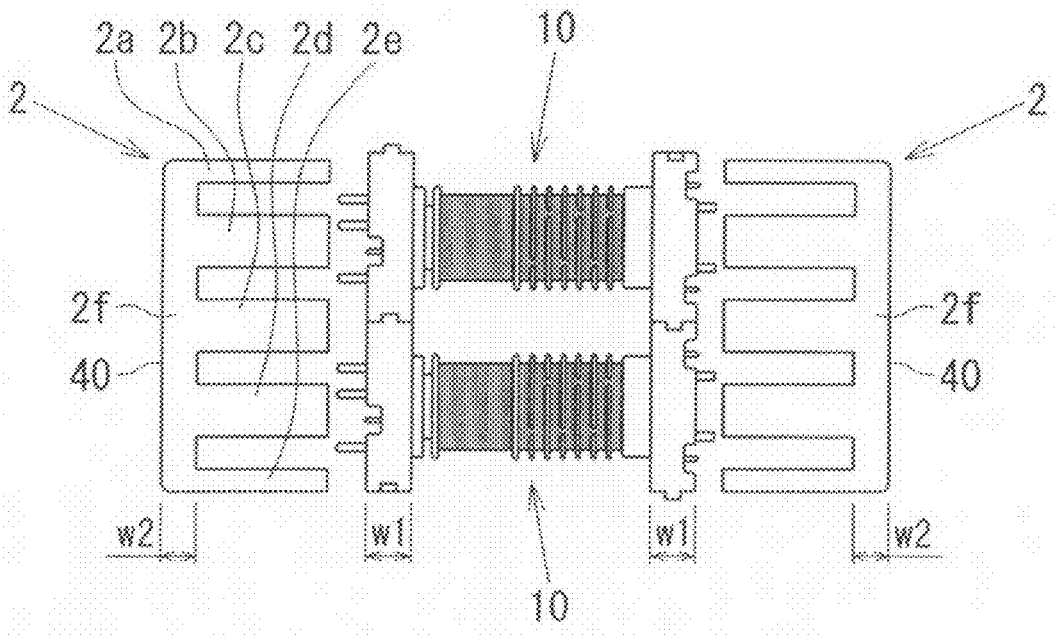
FIG. 2 is an exploded top plan view of the inverter transformer of FIG. 1.

Referring to FIGS. 1 and 2, an inverter transformer 1 is a two output transformer and includes: a core structure composed of two E-type cores 2, 2 which are made of, for example, Ni—Zn ferrite, and which each include a base bar 2*f* and five legs 2*a* to 2*e* extending orthogonally from the base bar 2*f*, wherein the base bar 2*f* and the legs 2*a* and 2*e* disposed at the both outermost positions constitute an outer core section, and the legs 2*b*, 2*c* and 2*d* disposed therebetween constitute an inner core section; two bobbins 10 made of synthetic resin, such as liquid polymer and formed into a rectangular hollow cylinder; two primary windings 20, 20 wound respectively around the two bobbins 10, 10; and two secondary windings 21, 21 wound respectively around the two bobbins 10, 10. The legs 2*b* and 2*d* of one E-type core 2 are inserted respectively in the hollows of the two bobbins 10, 10 from their one end openings while the legs 2*b* and 2*d* of the other E-type core 2 are inserted respectively in the hollows of the two bobbins 10, 10 from their other end openings, and the distal tip ends of the respective legs 2*b*/2*d* of both the two E-type cores 2, 2 are brought into contact with each other, thus forming an EE-type core structure.

Figure 3:
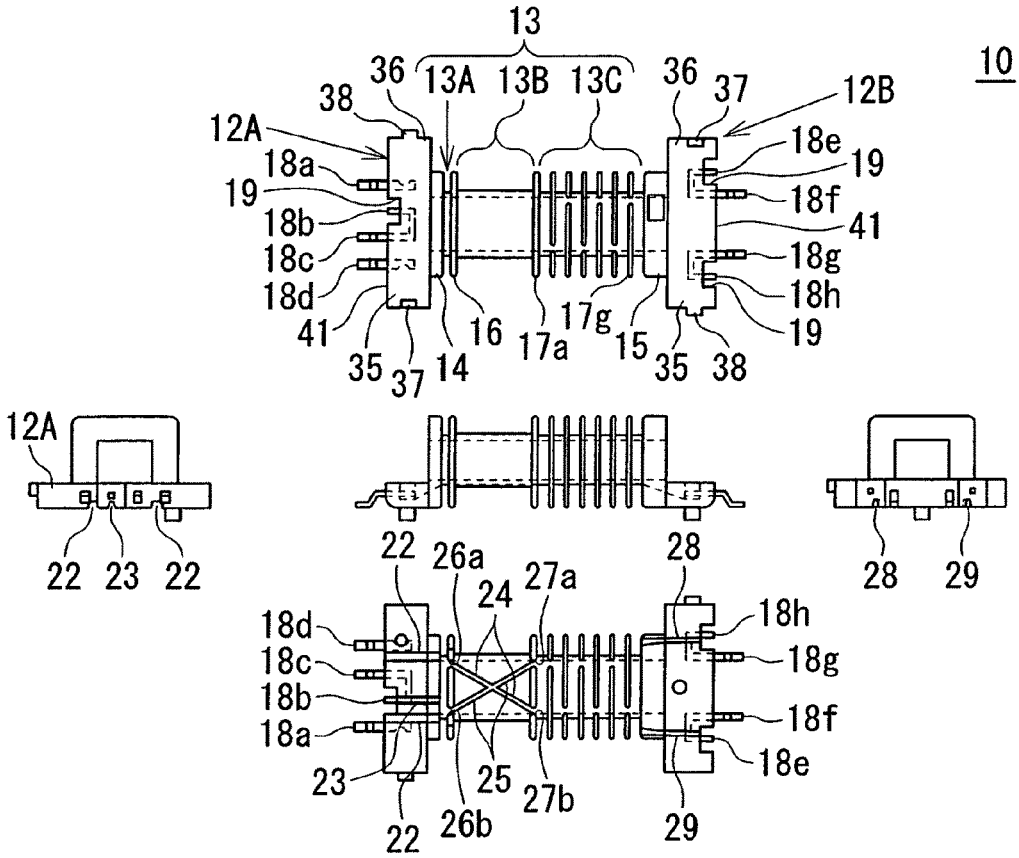
FIG. 3 is a set of views of a bobbin used in the inverter transformer of FIG. 1, specifically, a top plan view, a front elevation view, right and left side views, and a bottom view.

The bobbin 10 will be further described with reference principally to FIGS. 3 and 4. The bobbin 10 generally includes a spool portion 13 and first and second terminal blocks 12A and 12B integrally formed at respective ends of the spool portion 13. The spool portion 13 includes a first end plate 14 at one end thereof connecting to the first terminal block 12A and a second end plate 15 at the other end thereof connecting to the second terminal block 12B. The spool portion further includes a first flange 16 located close to the first end plate 14, and a partition array 17 composed of seven partitions 17*a* to 17*g* and disposed toward the second end plate 15 with the partition 17*g* located next to the second end plate 15. The spool portion 13 structured as described above is divided into three winding sections, specifically a first winding section 13A, a second winding section 13B, and a third winding section 13C. The first winding section 13A is defined between the first end plate 14 and the flange 16, the second winding section 13B is defined between the flange 16 and the partition 17*a* of the partition array 17, and the third winding section 13C is defined between the partition 17*a* and the second end plate 15 and subdivided into seven sub-sections by the partitions 17*b* to 17*g* of the partition array 17 (refer to FIG. 1). The primary winding 20 is wound at the second winding section 13B, and the secondary winding 21 is wound at the third winding section 13C and equally split by the partitions 17*b* to 17*g* into seven sub-windings continuously connected in series as shown in FIG. 1.

The first terminal block 12A of the bobbin 10 located toward the first winding section 13A has terminal pins 18*a* to 18*d* implanted therein, and the second terminal block 12B located toward the third winding section 13C has terminal pins 18*e* to 18*h* implanted therein. The terminal pins 18*a* and 18*d* are for the primary winding 20, and the terminal pins 18*b*, 18*c* and 18*e* to 18*h* are for the secondary winding 21 with the terminal pins 18*b* and 18*c* thereof connected to grounding. The terminal pins 18*b* and 18*c* are integrally jointed to each other into a one-piece member bent to form a substantially J-shape. In the same way, the terminal pins 18*e* and 18*f*, and also the terminal pins 18*g* and 18*h* are structured into an integral J-shaped member. The terminal pins 18*b*, 18*e* and 18*h*, which are the shorter arms of respective J-shaped structures, are for tying of the wires of the secondary winding 21, and the terminal pins 18*c*, 18*f* and 18*g*, which are the longer arms thereof, are for connection to a printed circuit board. A recess 19 is formed at an end face 41 of the first terminal block 12A, and two recesses 19 are formed at the end face 41 of the second terminal block 12B. The terminal pins 18*b*, 18*e* and 18*h* for tying the wires of the secondary winding 21 therearound (hereinafter, the terminal pins 18*b*, 18*e* and 18*h* are collectively referred to as "secondary winding wire tying terminal pins" as appropriate) are lodged in the recesses 19, more specifically the terminal pin 18*b* is lodged in the recess 19 of the first terminal block 12A while the terminal pins 18*e* and 18*h* are lodged in the two recesses 19, respectively, of the second terminal block 12B such that the tip ends thereof are positioned substantially flush with the end faces 41.

The bottom face of the first terminal block 12A (including the end plate 14) is provided with two guide grooves 22, 22 for the primary winding 20 and one guide groove 23 for the secondary winding 21 (the guide grooves 22, 22 and 23 are defined as "first group grooves"), and the bottom face of the second terminal block 12B (including the end plate 15) is provided with two guide grooves 28 and 29 for the secondary winding 21 (the guide grooves 28 and 29 are defined as "third group grooves"). The lower side portion of the flange 16 is provided with two notches 26*a* and 26*b* positioned apart from each other, and the lower side portion of the partition 17*a* of the partition array 17 is provided with two notches 27*a* and 27*b* positioned corresponding respectively to the notches 26*a* and 26*b* of the flange 16. The upper and lower side portions of the remaining partitions 17*b* to 17*g* are provided with notches in an appropriate manner. A guide groove 24 is obliquely formed in a straight line at the lower face of the second winding section 13B of the spool portion 13 so as to connect between the notch 26*a* of the flange 16 and the notch 27*b* of the partition 17*a*, and a guide groove 25 is obliquely formed in a straight line also at the lower face of the second winding section 13B so as to connect between the notch 26*b* of the flange 16 and the notch 27*a* of the partition 17*a* thereby crossing the guide groove 24 (the guide grooves 24 and 25 are defined as "second group grooves"). The bottom planes of the grooves 24 and 25 and the notches 26*a*, 26*b*, 27*a* and 27*b* are flush with the lower surface of the first winding section 13A.

Figure 4:
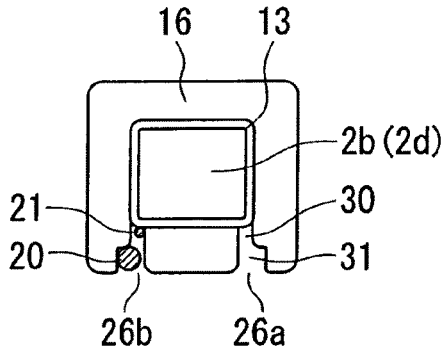
FIG. 4 is a cross sectional view of a flange of the bobbin of FIG. 3.

Referring to FIG. 4, the notches 26*a* and 26*b* of the flange 16 each integrally include a first portion 30 and a second portion 31 having their respective different widths so as to form a step configuration. The first portion 30 is located toward the surface of the spool portion 13 and has a width which is slightly larger than the diameter of the wire of the secondary winding 21 and at the same time is smaller than the diameter of the wire of the primary winding 20, and the second portion 30 is located toward the circumference of the flange 16 and has a width slightly greater than the diameter of the wire of the primary winding 20, whereby the wire of the primary winding 20 is prevented from making contact with the wire of the secondary winding 21 which is previously set in the first portion 30, thus enhancing productivity and reliability.

The guide groove (first group) 23 formed at the first terminal block 12A and the guide grooves (third group) 28 and 29 formed at the second terminal block 12B have their widths tapering in an upward direction from the bottom faces of the first and second terminal blocks 12A and 12B so as to have a trapezoidal cross section (refer to the side views of FIG. 3), and the smallest width of the trapezoidal figure is slightly greater than the diameter of the wire of the secondary winding 21, whereby the wire of the secondary winding 21 can fit readily and securely in the guide grooves 23, 28 and 29, thus enhancing productivity and reliability.

The first/second terminal block 12A/12B has its both sides protruding beyond the outer dimension of the end plates 14/15, the flange 16 and the partition array 17 so as to constitute extensions 35 and 36, whereby the spool portions 13 of two adjacent bobbins 10 and 10 are set apart from each other so as to achieve an appropriate insulation distance therebetween thus enhancing safety as well as reliability. The extensions 35 and 36 have a recess 37 and a boss 38, respectively, which engage with each other when two or more of the bobbins 10 are coupled together, thus achieving a solid structure.

Description will now be made on a method of assembling the inverter transformer 1.

To begin with, a procedure to wind the primary and secondary windings 20 and 21 on the bobbin 10 will be explained with reference to FIGS. 5A, 5B and 6.

Figure 5A:
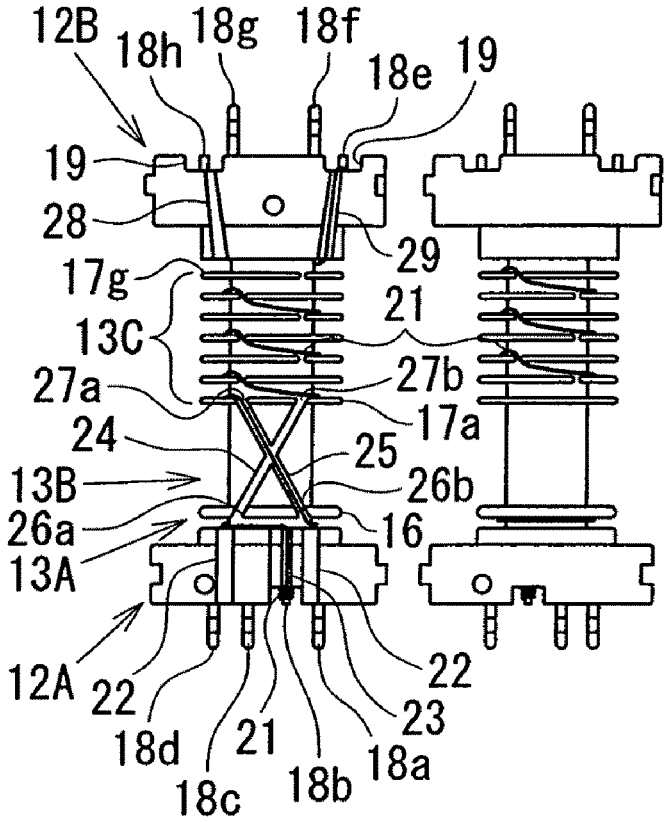
FIG. 5A is a schematic bottom view of a winding mode (CW direction) of a secondary winding of the inverter transformer of FIG. 1.
Figure 6:
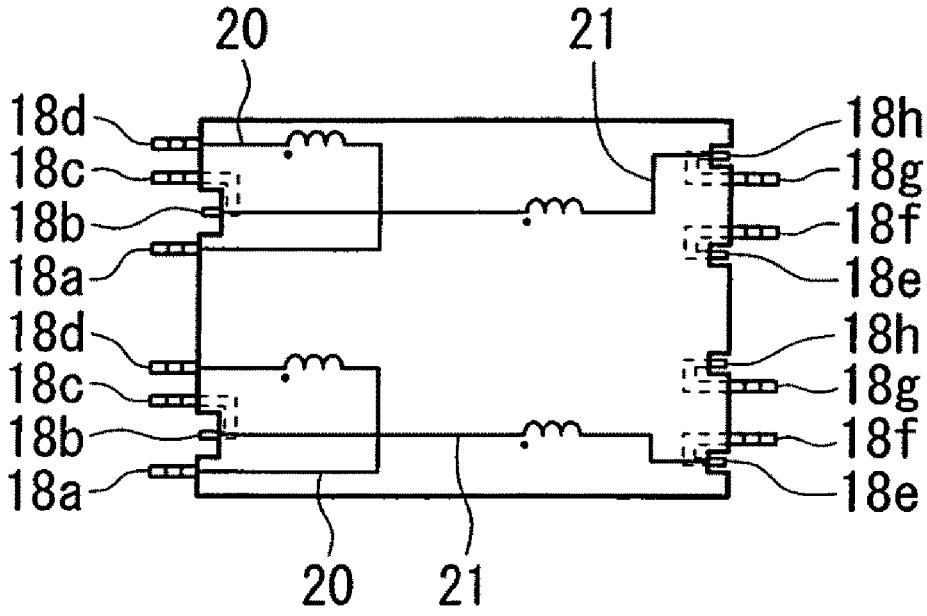
FIG. 6 is a schematic bottom view of a circuit diagram of the inverter transformer of FIG. 1.

Referring to FIG. 5A, description will be made on how the secondary winding 21 is wound on the bobbin 10 in the clockwise direction seen from the second terminal block 12B. The wire for the secondary winding 21 has its one end (starting end) tied around the secondary winding wire tying terminal pin 18*b* of the first terminal block 12A, is guided through the guide groove 23 of the first terminal block 12A to the first winding section 13A of the spool portion 13 so as to be wound clockwise therearound by one turn, then guided through the first portion 30 of the notch 26*b* of the flange 16, the guide groove 25, and the notch 27*a* of the partition 17*a* to the third winding section 13C so as to be wound clockwise therearound by a specified number of turns equally split into seven sub-windings by the partitions 17*b* to 17*g*, further guided through the guide groove 29 of the second terminal block 12B to the secondary winding wire tying terminal pin 18*e*, and has its other end (finishing end) tied therearound.

Figure 5B:
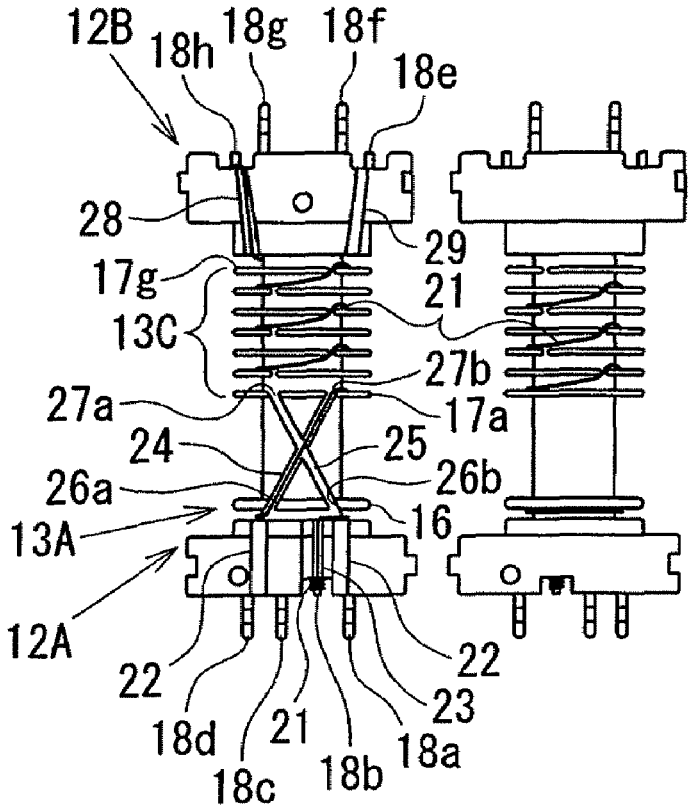
FIG. 5B is schematic bottom view of another winding mode (CCW direction) of a secondary winding of the inverter transformer of FIG. 1.

Referring now to FIG. 5B, description will be made on how the secondary winding 21 is wound on the bobbin 10 in the counter-clockwise direction. The wire for the secondary winding 21 has its one end tied around the secondary winding wire tying terminal pin 18*b*, is guided through the guide groove 23 to the first winding section 13A so as to be wound counter-clockwise therearound by one turn, then guided through the first portion 30 of the notch 26*a*, the guide groove 24, and the notch 27*b* to the third winding section 13C so as to be wound counter-clockwise therearound by a specified number of turns equally split into seven sub-windings by the partitions 17*b* to 17*g*, further guided through the guide groove 28 of the second terminal block 12B to the secondary winding wire tying terminal pin 18*h*, and has its other end tied therearound.

And, though not illustrated, after the secondary winding 21 is wound on the bobbin 10 either clockwise or counterclockwise as described above, the primary winding 20 is wound as follows. The wire for the primary winding 20 has its one end tied around one terminal pin, for example, 18*d* out of the two terminal pins 18*a* and 18*d*, is guided through one guide groove 22 of the first terminal block 12A positioned close to the aforementioned terminal pin 18*d*, passes by the first winding section 13A of the spool portion 13, is guided to the second winding section 13B through the second portion 31 of the notch 26*a* of the flange 16 positioned close to the aforementioned one guide groove 22, wound around the second winding section 13B up to the partition 17*a*, then wound in the backward direction to the flange 16 to complete a specified number of turns, guided through the second portion 31 of the notch 26*b* of the flange 16, passes by the first winding section 13A, is guided to the terminal pin 18*a* through the other guide groove 22 of the first terminal block 12A, and has its other end tied around the terminal pin 18*a*.

The primary and secondary windings 20 and 21 wound as described above constitute a circuit shown in FIG. 6.

According to the winding procedure described above, the winding direction (CW vs. CCW) of the secondary winding 21 can be easily reversed thereby enabling a desired voltage polarity to be achieved at the secondary side of the inverter transformer 1, whereby it is possible that two of the secondary windings 21 adjacent to each other have their respective voltage polarities flexibly determined, that is to say, identical with each other or opposite to each other. Also, the wire of the secondary winding 21 can fit tightly on the first winding section 13A due to the one turn winding and also can sit readily and securely in the second group groove 24/25 which is formed at the second winding section 13B with its bottom plane arranged flush with the surface of the first winding section 13A, whereby the wire of the secondary winding 21 disposed at the second winding section 13B is well prevented from receiving stresses from the primary winding 20 which is wound on the wire of the secondary winding 21 at the second winding section 13B, thus enhancing reliability.

The two bobbins 10, 10 having the primary and secondary windings 20 and 21 wound therearound as described above are coupled to each other in a parallel position with their respective recesses 37 and bosses 38 engaging with each other, and respective legs 2*b* and 2*d* of two of the cores 2, 2 are inserted through respective hollows of the two bobbins 10, 10 from the both open ends and have their distal end faces brought in contact with each other so as to form an EE-type core structure while respective base bars 2*f* rest on the first and second terminal blocks 12A and 12B, thus the inverter transformer 1 is completed.

In the present embodiment, the base bar 2*f* of the E-type core 2 has a width w2 substantially equal to a width w1 of the first/second terminal block 12A/12B on which the base bar 2*f* is disposed (refer to FIG. 2) whereby the core structure composed of two of the E-type cores 2, 2 has its end faces 40 coinciding with the end faces 41 of the first and second terminal blocks 12A and 12B and therefore covers the recesses 19 of the first and second terminal blocks 12A and 12B from the upper side. Accordingly, the secondary winding wire tying terminal pins 18*b*, 18*e* and 18*h* which are disposed in the recesses 19 and have their distal tip ends positioned substantially flush with the end faces 41 of the first and second terminal blocks 12A and 12B are covered up by the base bars 2*f* from the upper side.

When the inverter transformer 1 structured as described above is mounted on a printed circuit board, the secondary winding wire tying terminal pins 18*b*, 18*e* and 18*h* are covered by the first/second terminal block 12A/12B in the both side directions, covered by the base bar 12*f* the core 2 in the upper direction, and covered by the printed circuit board in the lower side direction thus being open in the extending direction only, but the tip ends of the secondary winding wire tying terminal pins 18*b*, 18*e* and 18*h* still do not protrude. Consequently, the secondary winding wire tying terminal pins 18*b*, 18*e* and 18*f* have a reduced chance to receive an external force and therefore are better protected from wire breakage while providing a comfortable tying space within a limited dimension.

The inverter transformer 1 may be used as a leakage transformer, in which case the leakage inductance of the inverter transformer can function as ballast at the time of lighting a cold cathode fluorescent lamp connected to the secondary side of the inverter transformer.

While the present invention has been explained with reference to the exemplary embodiment, it is to be understood that the present invention is by no means limited to the specific embodiment but encompasses all changes and modifications that will become possible within the scope of the invention. For example, it may be possible that the distal tip ends of the secondary winding wire tying terminal pins 18*b*, 18*e* and 18*h* are positioned inward of the end face 41 of the first/second terminal block 12A/12B (closer to the spool portion 13) and/or that the end face 40 of the core structure composed of two of the E-type cores 2, 2 oriented orthogonal to the extending direction of the secondary winding wire tying terminal pins 18*b*, 18*e* and 18*h* is positioned outward of the distal tip ends of the secondary winding wire tying terminal pins 18*b*, 18*e* and 18*h*.

Also, the core structure may alternatively be composed of, for example, a square frame-shaped core as an outer core section and a plurality of I-shaped cores as an inner core section disposed inside the square frame-shaped core, or composed of an E-type core having legs and an I-shaped core disposed at the distal ends of the legs. Further, the number of bobbins is not limited to two, and four or six bobbins may be employed in consideration of the outer dimension of an inverter transformer.

What is claimed is:

1. An inverter transformer comprising:

a core structure comprising an outer core section and an inner core section;

a plurality of bobbins each comprising a spool portion having a hollow, and first and second terminal blocks disposed respectively at both ends of the spool portion, wherein the inner core section of the core structure is inserted in the hollow of the spool portion, the first terminal block has a recess formed at an end face thereof and lodging a terminal pin, the second terminal block has two recesses formed at an end face thereof and lodging two terminal pins, respectively, distal tip ends of the terminal pins lodged in the recesses of the first and second terminal blocks are positioned either flush with or inward of the end faces of the first and second terminal blocks, part of the core structure is located above the recess, and an end face of the core structure oriented substantially orthogonal to an extending direction of the terminal pins is positioned either flush with or outward of the distal tip ends of the terminal pins; and primary and secondary windings wound around the spool portion, wherein one wire end of the secondary winding is tied around the terminal pin lodged in the recess of the first terminal block, and another wire end of the secondary winding is tied around one of the two terminal pins lodged respectively in the two recesses of the second terminal block.

2. An inverter transformer according to claim 1, wherein: the spool portion of the bobbin comprises a first winding section located toward the first terminal block, a second winding section located next to the first winding section and adapted to have the primary winding wound therearound, and a third winding section located toward the second terminal block so as to sandwich the second winding section with the first winding section and adapted to have the secondary winding wound therearound; the first terminal block is provided with first group grooves; the second winding section is provided with second group grooves whose bottom planes are substantially flush with a surface of the first winding section; the second terminal block is provided with third group grooves; and a wire of the secondary winding has its one end tied around the terminal pin lodged in the recess of the first terminal block, passes through one groove of the first group grooves of the first terminal block, is wound at the first winding section by one turn, and passes through one of the second group grooves of the second winding section thereby reaching the third winding section.

3. An inverter transformer according to claim 2, wherein the bobbin comprises a flange which separates the first winding section and the second winding section, and which is provided with two notches each having a first portion positioned inward and a second portion positioned outward, directly continuous with the first portion and having a greater width than the first portion thus constituting a step configuration.

4. An inverter transformer according to claim 2, wherein the first group grooves of the first terminal block and the third group groove of the second terminal block have a trapezoidal cross section tapering inward from surfaces of the first and second terminal blocks.

5. An inverter transformer according to claim 1, wherein the inverter transformer is a leakage transformer.

* * * * *